United States Patent [19]

Kobayashi

[11] Patent Number: 4,783,074

[45] Date of Patent: Nov. 8, 1988

[54] PUZZLE WITH TIMER CONTROLLED DISASSEMBLING MEANS

[75] Inventor: Toshio Kobayashi, Chiba, Japan

[73] Assignee: Asahi Corporation, Tokyo, Japan

[21] Appl. No.: 82,096

[22] Filed: Aug. 5, 1987

[30] Foreign Application Priority Data

Aug. 7, 1986 [JP] Japan ..... 61-185885

[51] Int. Cl.[4] ..... A63F 9/12

[52] U.S. Cl. ..... 273/157 R; 273/1 GF

[58] Field of Search ..... 273/156, 157 R, 1 G, 273/1 GF

[56] References Cited

U.S. PATENT DOCUMENTS 3,710,455 1/1973 Liversidge et al. ..... 273/156 X
4,149,717 4/1979 Seijiro ..... 273/157 R X
4,366,957 1/1983 Aldcroft et al. ..... 273/1 GF

FOREIGN PATENT DOCUMENTS 2176411 12/1986 United Kingdom ..... 273/157 R

*Primary Examiner*—Anton O. Oechsle

*Attorney, Agent, or Firm*—Salter & Michaelson

[57] ABSTRACT

An action toy game device includes a base, a timer in the base, a plurality of puzzle elements which are adapted to be assembled in predetermined assembled positions on the base, and a disassembling mechanism which is responsive to the timer for disassembling any puzzle elements which have been assembled on the base in the event that all of the puzzle elements have not been assembled in the assembled positions thereof before the expiration of a set period of time. The disassembling mechanism preferably includes an action toy element which is receivable on the base and a mechanism for preventing the advancement of the timer before the action toy element is received on the base. In the preferred form of the device, the puzzle elements are adapted to be assembled on the base to form an egg-shaped structure, and the disassembling mechanism is adapted so that the action toy element is propelled upwardly from the base for engaging any assembled puzzle elements in the event that all of the puzzle elements have not been assembled within the set period of time.

11 Claims, 12 Drawing Sheets

PUZZLE WITH TIMER CONTROLLED DISASSEMBLING MEANS

BACKGROUND AND SUMMARY OF THE INVENTION

The instant invention relates to amusements games and more particularly to a toy game device of a type including a plurality of puzzle elements which must be assembled in predetermined assembled positions thereof within a set period of time.

Games in which game players are required to perform certain activities within set periods of time have generally been found to have significant degrees of amusement value. Further, games of this general type which include amusing action toy game devices which must be manipulated in predetermined ways during set periods of time have been found to be effective for increasing manual dexterity and hand-to-eye coordination.

The instant invention provides an effective action toy game device of the general type which is adapted to be manipulated by game players during set periods of time. More specifically, the instant invention provides an action toy game device comprising a base, a timer on the base, a plurality of puzzle elements which are adapted to be assembled in predetermined assembled positions on the base, and disassembling means responsive to the timer for disassembling any of the puzzle elements which have been assembled on the base in the event that all of the puzzle elements have not been assembled in the assembled positions thereof before the expiration of a set period of time. The toy game device is preferably constructed so that when the puzzle elements are in the assembled positions thereof, they cooperate with the base to form a substantially enclosed egg-shaped structure, and the disassembling means preferably includes an action toy element which is formed in the configuration of a toy character figure and which is receivable on the base so that it is positioned in the interior of the enclosed structure when the puzzle elements are in the assembled positions thereof. The disassembling means preferably further comprises a loading member which is resiliently depressible in the base to releasably secure it in a loaded position. Further, the action toy element is preferably receivable on the loading member for moving the loading member to the loaded position thereof, and the loading member is constructed so that it is releasable to propel the action toy element into engagement with at least a portion of any assembled puzzle elements on the base in order to disassemble the assembled puzzle elements in the event that all of the puzzle elements have not been assembled in the assembled positions thereof before the expiration of the set period of time. The disassembling means preferably further includes a plunger element which is depressible for preventing the actuation of the disassembling means to disassemble the assembled puzzle elements. In this regard, the action toy element preferably includes a depressible button member which is engageable by one of the puzzle elements for depressing the plunger element to maintain the plunger element in a depressed position in order to prevent the actuation of the disassembling means when all of the puzzle elements are in the assembled positions thereof. Further, the timer of the device is preferably adapted so that it is only operable when the loading memeber is in the loaded position thereof so that the timer can be preset before the action toy element is assembled on the base to load the loading member to the loaded position thereof.

Accordingly, for use and operation of the action toy game device of the instant invention, the timer is set to run for a set period of time, and the action toy element is assembled on the base so that the loading member is depressed to releasably secure it in a loaded position and to actuate the timer. Thereafter, the puzzle elements must all be assembled on the base so that they substantially enclose the action toy element before the expiration of the set period of time. In this connection, if the puzzle elements are all assembled in the assembled positions thereof before the expiration of the set period of time, the puzzle elements operate to depress the plunger element in order to prevent the timer from actuating the disassembling means. However, in the event that the puzzle elements have not all been assembled in the assembled positions thereof, before the expiration of the set period of time, the loading member is automatically released to propell the action toy element against the assembled puzzle elements so that the assembled puzzle elements are disassembled as the toy "explodes".

Accordingly, it is an primary object of the instant invention to provide an effective action toy game device, including a plurality of puzzle elements which must be assembled in predetermined assembled positions thereof within a set period of time.

Another object of the instant invention is to provide an effective action toy game device which includes a plurality of puzzle elements wherein the puzzle elements are automatically disassembled in the event that they are not assembled in the assembled positions thereof within a set period of time.

An even further object of the instant invention is to provide an action toy game device comprising a plurality of puzzle elements which are adapted to be assembled to form an egg-shaped structure, and a character figure which is operative for disassembling the puzzle elements in the event that they are not all assembled in the assembled positions thereof within a set period of time.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
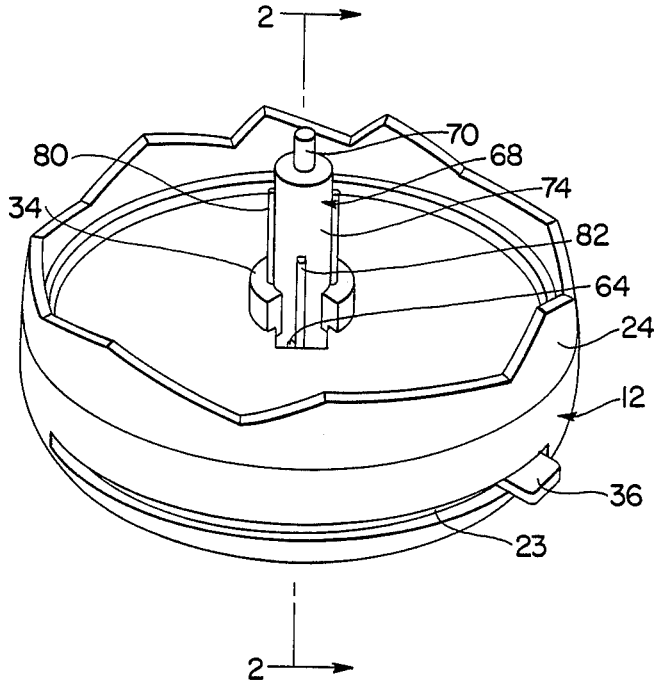
FIG. 1 is a perspective view of the base and the disassembling mechanism of the device of the instant invention with the timer in the fully wound position.
Figure 2:
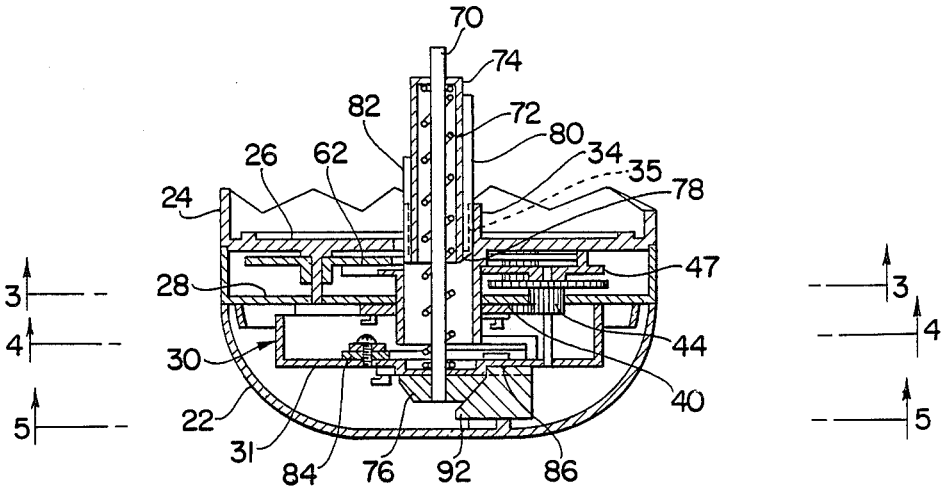
FIG. 2 is a sectional view taken along line 2—2 in FIG. 1.
Figure 5:
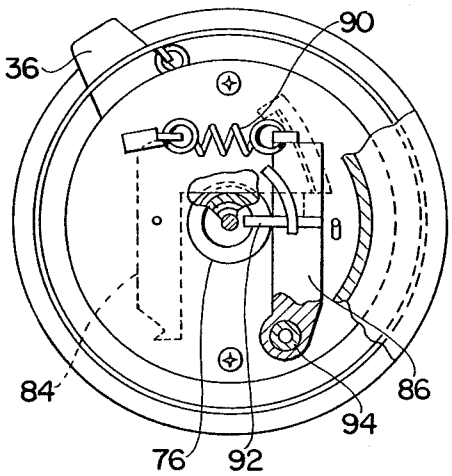
FIG. 5 is a sectional view taken along line 5—5 in FIG. 2.
Figure 4:
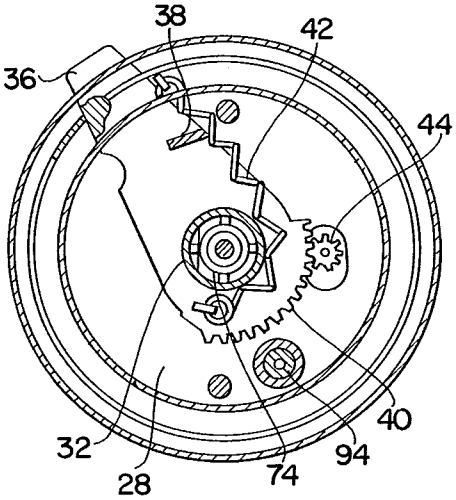
FIG. 4 is a sectional view taken along line 4—4 in FIG. 2.
Figure 3:
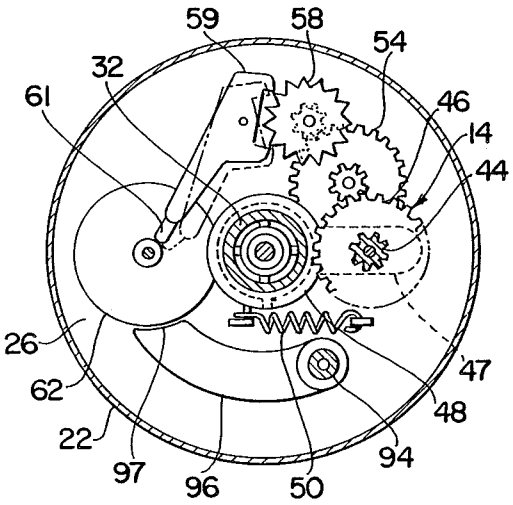
FIG. 3 is a sectional view taken along line 3—3 in FIG. 2.
Figure 6:
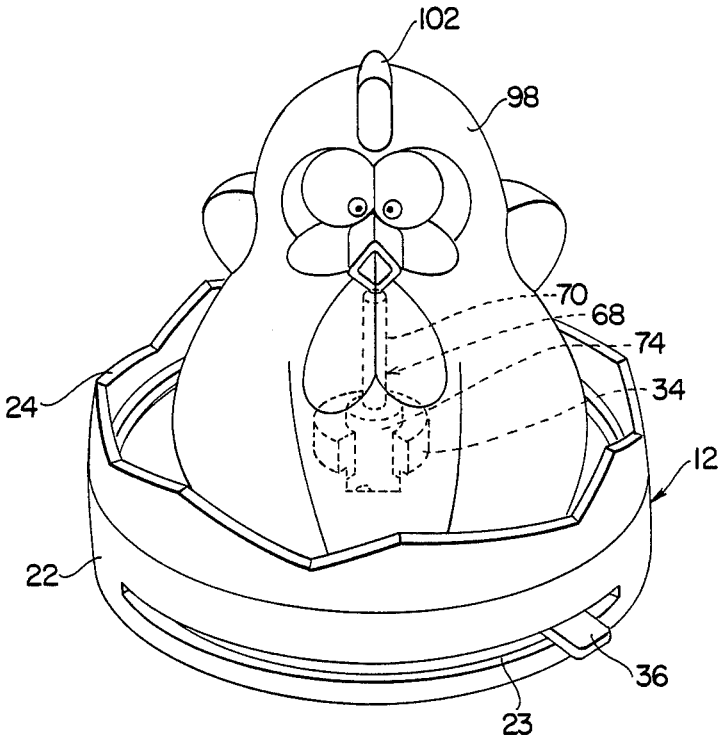
FIG. 6 is perspective view of the base with the action toy element assembled thereon.
Figure 7:
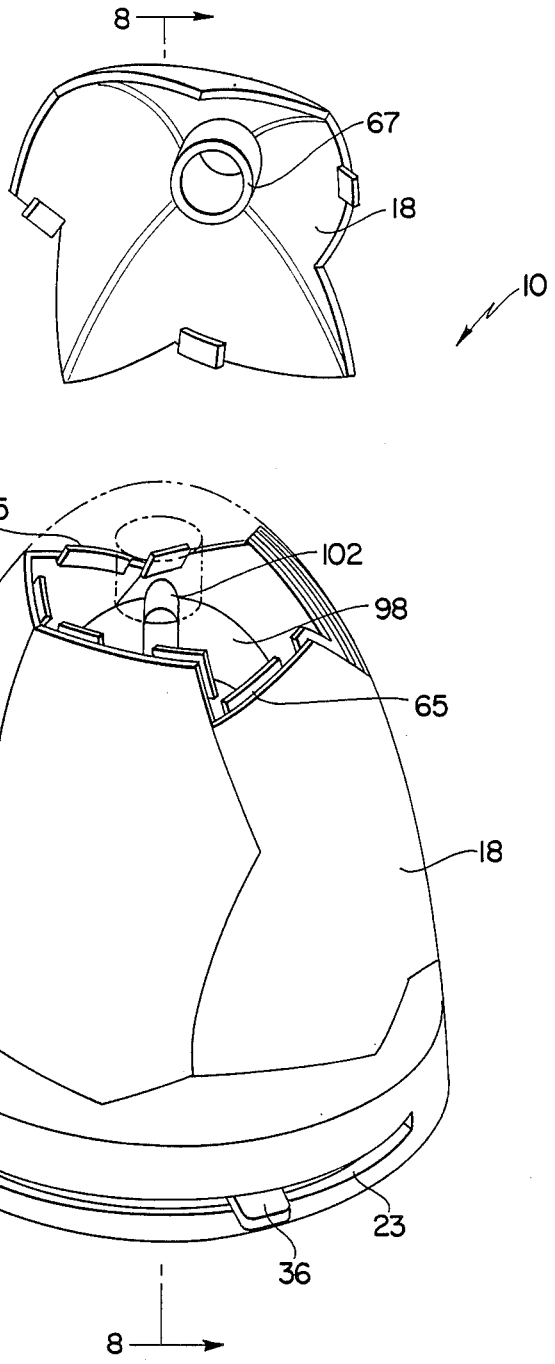
FIG. 7 is a perspective view of the device of the instant invention with a portion of the puzzle elements assembled on the base.
Figure 8:
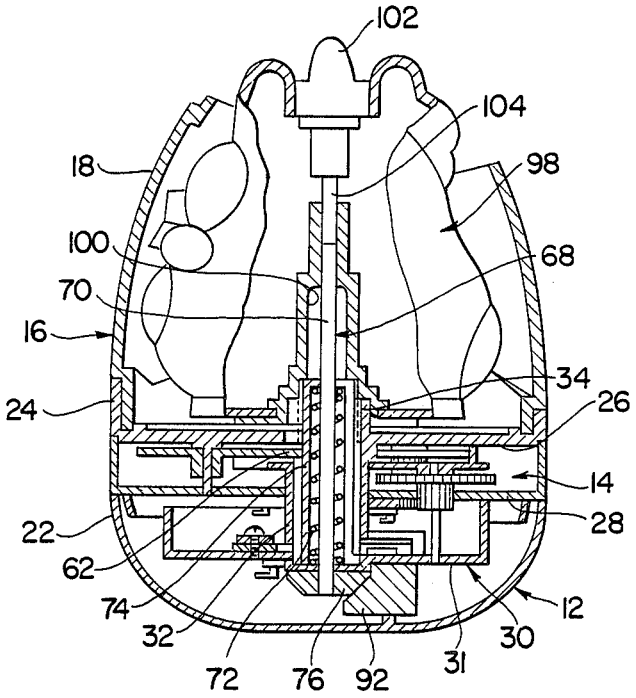
FIG. 8 is a sectional view taken along line 8—8 in FIG. 7.

Referring now to the drawings, the action toy game device of the instant invention is illustrated in FIGS. 1–18 and generally indicated at 10 in FIGS. 7, 9–11 and 15. As illustrated, the game device 10 includes a base generally indicated at 12, a timer mechanism generally indicated at 14, a puzzle assembly generally indicated at 16, which includes a plurality of puzzle elements 18, and a disassembling mechanism generally indicated at 20. The timer mechanism 14 is mounted in the base 12 and it is actuatable for set periods of time, and the puzzle elements 18 are adapted to be assembled in predetermined assembled positions on the base 12. The disassembling mechanism 20 is responsive to the timer mechanism 14, and it is operative for disassembling any puzzle elements 18 which have been assembled on the base 12 in the event that all of the puzzle elements 18 have not assembled in the assembled positions thereof prior to the expiration of the set period of time.

The base 12 is preferably made from a suitable rigid plastic material, and it provides a supporting structure for the puzzle assembly 16 and a housing for the timer mechanism 14 and portions of the disassembling mechanism 20. The base 12 comprises a lower housing section 22 having an elongated circumferentially extending slot 23 therein, an upper housing section 24 which is received on the lower housing section 22, a top wall 26, which extends across the interior of the base 12, an intermediate interior wall 28, and a lower interior housing section 30 including a bottom wall 31. A tubular sleeve 32 is formed in the central portion of the top wall 26, and it passes downwardly through the intermediate wall 28. A tubular neck 34 which is aligned with the sleeve 32 projects upwardly from the top wall 26, and an aperture which is also aligned with the axis of the sleeve 32 is formed in the lower wall 31 of the interior housing section 30. The neck 34 projects upwardly a short distance from the top wall 26, and it has a plurality of longitudinally extending grooves 35 therein.

The timer mechanism 14 is illustrated most clearly in FIGS. 3, 4, 12, 13, 16 and 17, and it comprises a conventional timer device which is manually settable for various time periods. In this regard, the timer mechanism 14 includes a control lever 36 which is mounted on the underside of the intermediate wall 28 so that it is rotatable around the sleeve 34 with the outer portion of the lever 36 traveling in the slot 23. The control lever 36 is integrally formed with a downwardly extending finger 38 and a fan gear 40, and it is attached to a drive spring 42 which is operative for resiliently returning the control lever 36 to the unwound or unset position illustrated in FIGS. 15, 17 and 18. A reduced clutch gear 44 projects through an aperture in the intermediate wall 28 and is interengageable with the fan gear 40 for communicating motion to the remainder of the components in the timer mechanism 14, and an enlarged clutch gear 46 is integrally attached to the reduced clutch gear 44 and mounted on a common shaft therewith. The shaft on which the transmission gears 44 and 46 are mounted is rotatably mounted in an arm 47 projecting outwardly from a collar 48 which is rotatably received around the sleeve 32, and a spring 50 biases the collar 48 to a position wherein the enlarged clutch gear 46 is in interengagement with a reduced transmission gear 52. Accordingly, as the control lever 36 is moved toward a wound position wherein the spring 42 is expanded by an increased amount, the enlarged clutch gear 46 is swung away from the transmission gear 52 against the force of the spring 30 so that the clutch gear 46 is disengaged from the transmission gear 52. However, as the control lever 36 is returned to the unwound position by the spring 42, the enlarged clutch gear 46 interengages the transmission gear 52 to effect rotation thereof. The reduced transmission gear 52 is integrally formed with an enlarged transmission gear 54 which communicates with an escape wheel transmission gear 56 for rotating an escapement wheel 58 which is integrally formed with the gear 56. The timer assembly 14 further comprises an escapement arm 59 having a pin 60 which is received in an elongated aperture 61 in a swing disc 62 having a projection 64 thereon. The escapement arm 59 swings back and forth as it engages the teeth of the escapement wheel 58 for oscillating the swing disc 62 as the escapement wheel 58 is rotated. The projection 64 is positioned so that it projects into the interior of the sleeve 32 so that it oscillates back and forth with the swing disc 62. Accordingly, during operation of the timer mechanism 14, the spring 42 drives the gears 44, 46, 52, 54 and 56 to rotate the escapement wheel 58 in order to thereby oscillate the swing disc 62 so that the projection 64 oscillates back and forth in the interior of the sleeve 32.

Figure 9:
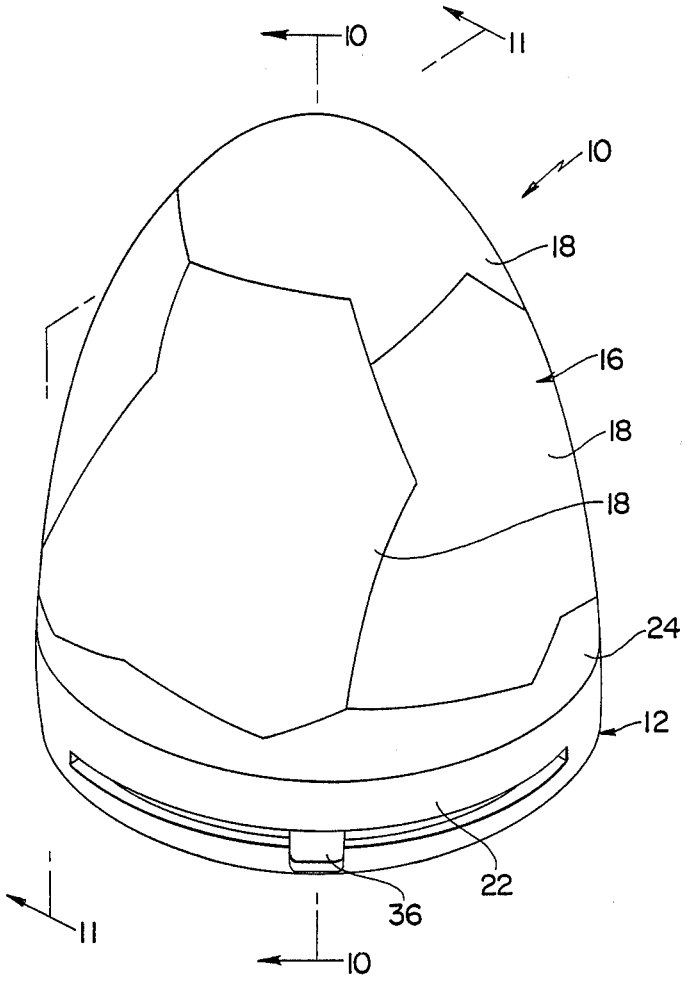
FIG. 9 is a fully assembled perspective view of the device of the instant invention with the timer in a partially wound position.
Figure 10:
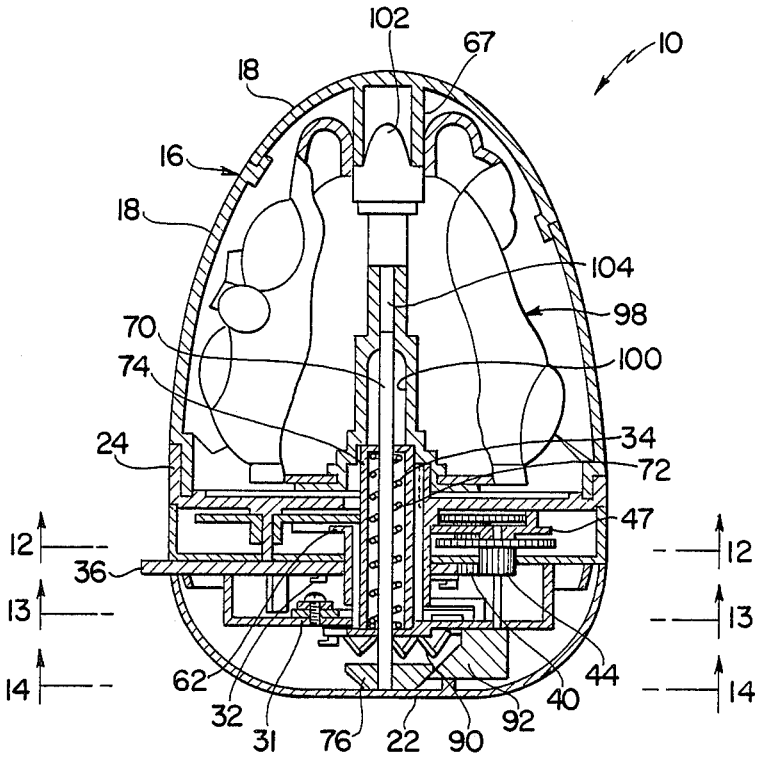
FIG. 10 is a sectional view taken along line 10—10 in FIG. 9.
Figure 11:
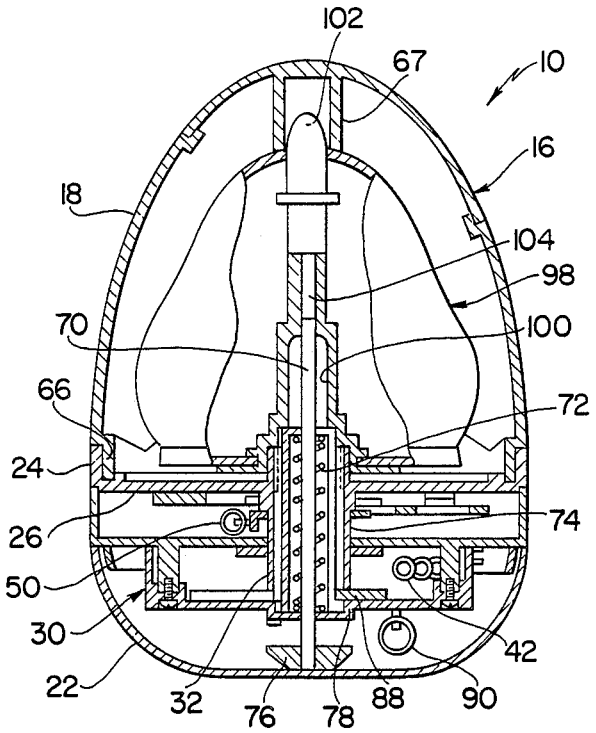
FIG. 11 is a sectional view taken along line 11—11 in FIG. 9.
Figure 14:
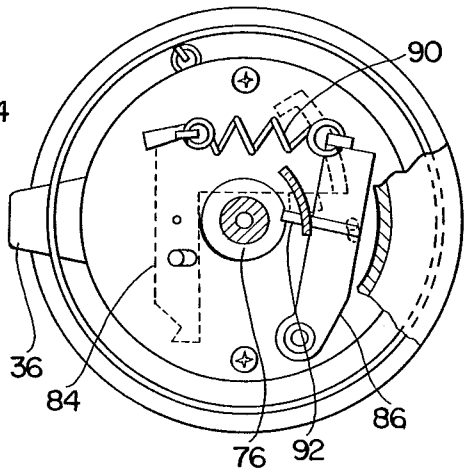
FIG. 14 is a sectional view taken along line 14–15 in FIG. 10.
Figure 13:
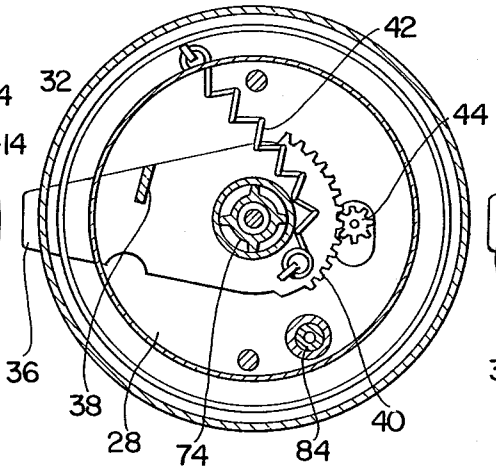
FIG. 13 is a sectional view taken along line 13—13 in FIG. 10.
Figure 12:
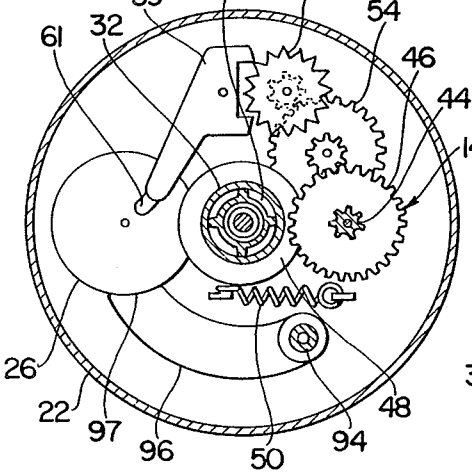
FIG. 12 is a sectional view taken along line 12—12 in FIG. 10.

The puzzle assembly 16 comprises a plurality of the puzzle elements 18 which are preferably made of a suitable rigid plastic and are adapted to be assembled in predetermined assembled positions on the base 12 so that they cooperate with the base 12 for defining a substantially egg-shaped structure as illustrated in FIGS. 9–11. The puzzle elements 18 include overlapping tongues 65 on the inner sides thereof for retaining the lower puzzle elements 18 in assembled relation, and the lower edges of the puzzle elements 18 include rims 66 on the inner sides thereof for retaining them in assembled relation on the base 12. As illustrated in FIGS. 10 and 11, the puzzle element 18 which defines the top of the eggshaped structure when all of the puzzle elements 18 are in assembled relation is integrally formed with a tubular element 67 which projects downwardly a short distance in the interior of the eggshaped structure.

Figure 15:
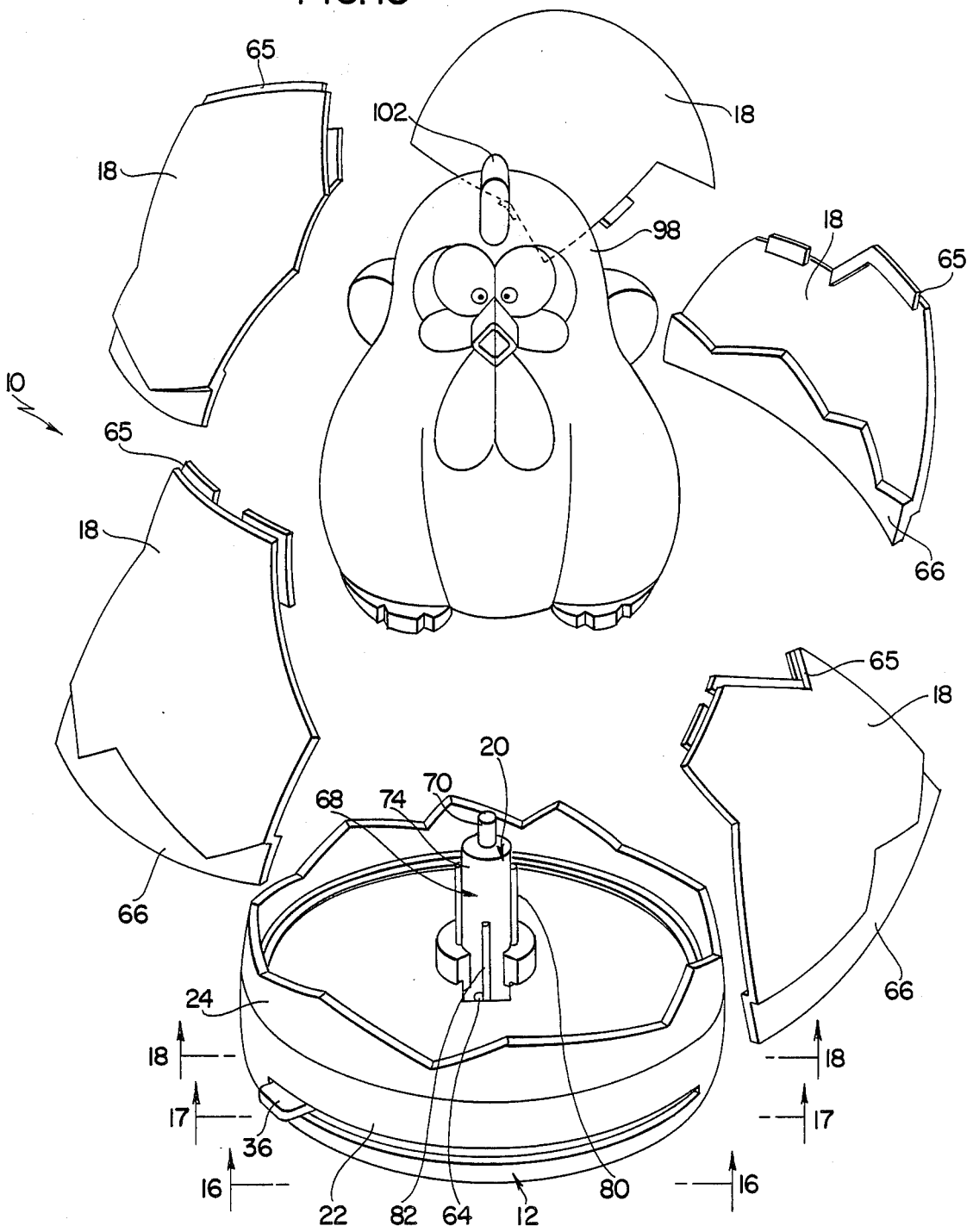
FIG. 15 is an exploded perspective view of the device of the instant invention with the timer in the unwound position.
Figure 18:
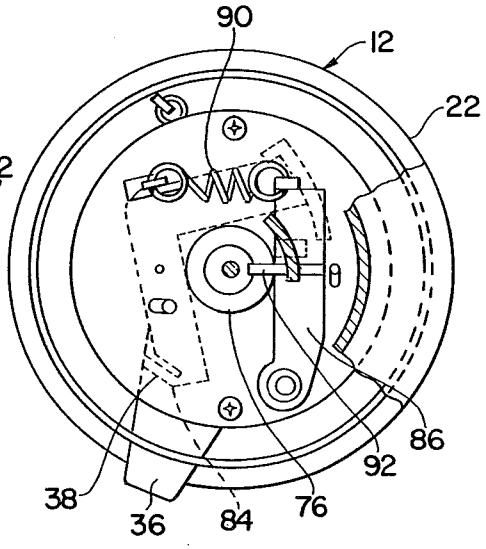
FIG. 18 is a sectional view taken along line 18—18 in FIG. 15.
Figure 17:
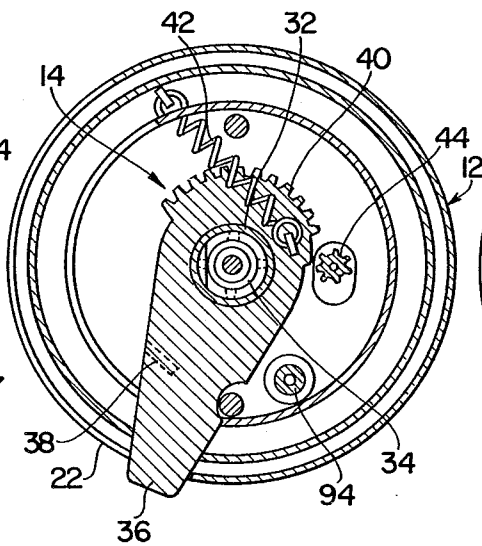
FIG. 17 is a sectional view taken along line 17—17 in FIG. 15.
Figure 16:
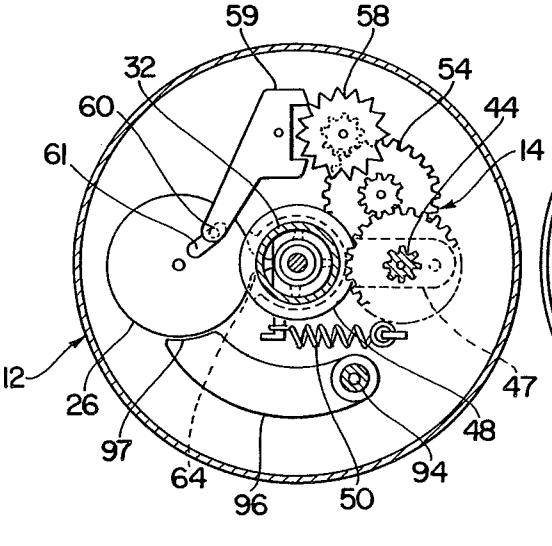
FIG. 16 is a sectional view taken along line 16—16 in FIG. 15.

The disassembling mechanism 20 is responsive to the timer mechanism 14 for disassembling the puzzle elements 18 in the event that all of the puzzle elements 18 have not all been assembled in the assembled positions thereof on the base 12 before the timer mechanism 14 is advanced to the unwound or unset position thereof. In this connection, the disassembling mechanism 20 includes a shaft assembly generally indicated at 68 comprising a push rod 70, a coil spring 72 on the push rod 70, a loading member 74 which is slidably received on the push rod 70, and a cam disc 76 which is permanently secured in a fixed position on the lower end of the push rod 70. The push rod 70 is assembled so that it extends through the bottom wall 31 of the lower housing section 30 with the cam disc 76 positioned beneath the bottom wall 31, and so that the loading member 74 is slidably received in the sleeve 32 and projects upwardly through the collar 34. In this connection, the loading member 72 is formed with a flange 78 on the lower end thereof, and as illustrated in FIGS. 1 and 15, it is further formed with a plurality of elongated longitudinally extending ribs 80 on the sides thereof and a single reduced longitudinally extending rib 82 which terminates in spaced relation to the upper end of the loading member 74. The ribs 80 are slidably received in the longitudinally extending grooves 35 in the neck 34, whereas the reduced rib 82 faces generally toward the swing disc 62. The loading member 74 is alternatively positionable in the upwardly projecting unloaded position illustrated in FIGS. 1, 2 and 15 or the downwardly depressed loaded position illustrated in FIGS. 8, 10 and 11, wherein the flange 78 is disposed adjacent the bottom wall of the interior housing section 30. In this connection, when the loading member 74 is in the upwardly projecting unloaded position thereof, the reduced rib 82 interferes with the oscillation of the projection 64 to prevent the advancement of the timer mechanism 14 to an unwound position. However, when the loading member 74 is depressed downwardly against the force of the spring 72 to the loaded position thereof, the reduced rib 82 is moved to a position wherein it is located entirely below the projection 64 so that the projection 64 can freely oscillate to allow the timer mechanism 14 to advance normally to an unwound position.

The disassembling mechanism 20 further comprises a locking arm 84 (illustrated in FIGS. 5, 14 and 18) which is pivotally mounted on the upper side of the bottom wall 31, and a break arm 86 which is pivotally mounted on the underside of the bottom wall 31. The locking arm 84 includes a locking leg 88, and it is biased to a position wherein the locking leg 88 is pivoted toward the push rod 70 with a spring 90 which also biases the break arm 86 toward the cam disc 76. The leg 88 of the locking arm 84 is engageable with the flange 78 on the bottom end of the loading member 74 to releasably retain the loading member 74 in the loaded position thereof wherein the flange 78 is adjacent the bottom wall 31, and the spring 72 is in a compressed disposition. However, the finger 38 on the lever 36 is adapted so that it engages the locking arm 84 when the lever 36 is in the unwound or unset position thereof for moving the leg 88 away from the push rod 70 to release the flange 78 from the leg 88. As a result, the loading member 74 is propelled upwardly by the spring 72 when the lever 36 is initially moved to the unloaded or unset position thereof. The break arm 86 includes a cam member 92 which is positioned adjacent the cam disc 76, and it is pivotally mounted on a shaft 94. Accordingly, when the push rod 70 is depressed to move the cam disc 76 downwardly, the cam disc 76 enages the cam member 92 to swing the break arm 86 outwardly against the force of the spring 90 as illustrated in FIG. 10. In this regard, the shaft 94 extends through the bottom wall 31 of the interior housing section 30 and through the intermediate wall 28, and a break member 96 is mounted on the shaft 94 above the intermediate wall 28 so that it moves with the break arm 86. The break member 96 includes an arcuate edge 97, and it is positioned so that the arcuate edge 97 is engageable with the swing disc 62 to prevent rotation of the swing disc 62. Accordingly, when the cam disc 76 engages the cam member 92 to swing the break arm 86 outwardly, the edge 97 of the break member 96 is moved into a position of engagement with the swing disc 62 to prevent further oscillating movement of the swing disc 62. In other words, by depressing the plunger 70 to swing the break arm 86 outwardly, the break member 96 is moved into enagement with the swing disc 62 to arrest further movement or advancement of the timer mechanism 14.

The disassembling mechanism 20 further comprises a character FIG. 98 which is receivable on the shaft assembly 68 so that it is positioned adjacent the top wall 26 of the base 12. In this regard, the character FIG. 98 is preferably formed in the configuration of an amusing character, and it is formed with a substantially vertically extending tubular passage 100 therein. The passage 100 is formed so that when the character FIG. 98 is positioned on the shaft assembly 68 and then depressed downwardly toward the base 12, the loading member 74 is moved downwardly in the housing 12 against the force of the spring 72 to the loaded position thereof, wherein the flange 78 is positioned adjacent the bottom wall 31. When the flange 78 is received against the bottom wall 31, the pivot member 84 is moved inwardly over the lip 78 so that it retains the loading member 74 in the loaded or cocked position thereof as long as the lever 36 is in an at least partially loaded or set position. However, when the loading member 74 is moved downwardly in this manner, the plunger element 70 remains stationary so that it extends upwardly into the passage 100 in the character FIG. 98. The character FIG. 98 is further formed with a depressible button member 102 at the upper end thereof, and a reduced shaft 104 which extends downwardly from the button member 102 for engaging the upper end of the push rod 70. In this regard, the button member 102 is normally supported in an upwardly extended position by the push rod 70 before the puzzle elements 18 are assembled on the base 12. However, when the uppermost puzzle element 18 is assembled with the other puzzle elements 18 on the base 12, the tubular element 66 engages the button member 102 to move the button member 102 downwardly so that the push rod 70 is also moved downwardly. As a result, when the uppermost puzzle element 18 is assembled with the other puzzle elements 18 on the base 12, the push rod 70 is moved downwardly so that the cam disc 76 moves the cam member 92 outwardly and thereby actuates the break element 96 to arrest the advancement of the timer mechanism 14.

Accordingly, during use and operation of the action toy game device 10, the timer mechanism 14 is set by moving the control lever 36 to a set or loaded position wherein the spring 42 is in an expanded disposition. As this takes place, the clutch gear 44 is pivoted away from the transmission gear 52 so that the enlarged clutch gear 46 can rotate freely without engaging the transmission gear 52. However, as soon as the control lever 36 is released, the clutch gears 44 and 46 are returned to their original positions wherein the enlarged clutch gear 46 engages the transmission gear 52 so that movement of the control lever 36 toward an unwound position causes the gears 44, 46, 52, 54 and 56 to rotate, whereby the escapement wheel 58 is rotated to oscillate the swing disc 62 and the projection 64. In this regard, as long as the loading member 74 is in the upwardly projecting unloaded position thereof, the rib 82 interferes with the movement of the projection 64 so that the timer mechanism 14 is prevented from advancing toward an unset or unwound position. However, by assembling the character FIG. 98 on the shaft assembly 68, the rib 82 is moved downwardly to a position beneath the projection 64 to enable the projection 64 to oscillate freely so that the timer mechanism 14 can advance in a normal manner. Once the loading member 74 has been depressed to the loaded position thereof, the pivot member 84 engages the flange 78 to retain the loading member 74 in the loaded position thereof as the timer mechanism 14 is advanced toward an unwound or unset position. However, if the uppermost puzzle element 18 is assembled with the other puzzle elements 18 before the timer mechanism 14 is moved to the unset position thereof, the button 102 is depressed by the uppermost puzzle element 18, and the plunger element 70 is moved downwardly causing the cam disc 76 to pivot the break arm 86 outwardly, whereby the break member 96 is moved into engagement with the swing disc 62 to arrest the advancement of the timer mechanism 14. On the other hand, if the button element 102 is not depressed in this manner, the timer mechanism 14 proceeds to the unwound or unset position thereof; and upon reaching the unwound or unset position thereof, the finger 38 engages the pivot member 84 to swing the leg 88 away from the push rod 70 so that the flange 78 is released from the leg 88. This causes the loading member 74 to be propelled upwardly by the spring 72 so that the character FIG. 98 is also propelled upwardly. As a result, the character FIG. 98 engages at least a portion of the puzzle elements 18 which have been assembled on the base 12 to completely disassemble all of the puzzle elements 18.

It is seen, therefore, that the instant invention provides an effective action toy game device which has a significant degree of amusement value. In particular, the device 10 provides an amusing game device wherein participants must assemble all of the puzzle elements 18 in predetermined assembled positions before the expiration of a set period of time. Further, in the event that all of the puzzle elements 18 have not been assembled in the assembled positions thereof before the timer mechanism 14 reaches the unset position thereof, the character FIG. 98 is propelled upwardly to disassemble all of the assembled puzzle elements 18. Accordingly, it is seen that the device 10 has a high degree of amusement value and that it therefore represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. An action toy game device comprising a base, a timer on said base, puzzle means including a plurality of puzzle elements adapted to be assembled in predetermined assembled positions on said base, and disassembling means on said base responsive to said timer for disassembling any assembled puzzle elements on said base upon the expiration of a set period of time, said disassembling means including means responsive to the placement of at least one of said puzzle elements in the assembled position thereof prior to the expiration of said set period of time for preventing disassembly of said puzzle elements by said disassembling means.

2. In the action toy game device of claim 1, said puzzle elements cooperating with said base to define a substantially enclosed structure when said puzzle elements are in the assembled positions thereof.

3. In the action toy game device of claim 2, said disassembling means engaging the inner sides of at least a portion of any assembled puzzle elements on said base to disassemble same in the event that all of said puzzle elements have not been assembled in the assembled positions thereof before the expiration of said set period of time.

4. In the action toy game device of claim 2, said disassembling means including an action toy element receivable on said base and disposed in the interior of said substantially enclosed structure when said puzzle elements are in the assembled positions thereof, said action toy element engaging at least a portion of any assembled puzzle elements to disassemble any assembled puzzle elements in the event that all of said puzzle elements have not been assembled in the assembled positions thereof before the expiration of said set period of time.

5. In the action toy game device of claim 4, one of said puzzle elements engaging said action toy element to prevent the disassembly of said puzzle elements by said disassembling means in the event that all of said puzzle elements have been assembled in the assembled positions thereof before the expiration of said set period of time.

6. In the action toy game device of claim 4, said assembling means further comprising means for propelling said action toy element against at least a portion of any assembled puzzle elements on said base to disassemble same in the event that all of said puzzle elements have not been assembled in the assembled positions thereof before the expiration of said set period of time.

7. In the action toy game device of claim 4, said action toy element further characterized as a toy character figure.

8. In the action toy game device of claim 7, said substantially enclosed structure being of egg-shaped configuration.

9. In the action toy game device of claim 4, said disassembling means including a plunger element, said plunger element being depressible for preventing the disassembly of said puzzle elements by said disassembling means and communicating with said puzzle means through said action toy element when all of said puzzle elements are in the assembled positions thereof for maintaining said plunger element in a depressed position to prevent the disassembly of said puzzle elements.

10. In the action toy game device of claim 4, said disassembling means including a loading member on said base, said loading member being resiliently depressible to releasably secure it in a loaded position, said action toy element being receivable on said loading member for moving same to the loaded position thereof, said loading member being released to propel said action toy element into engagement with at least a portion of any assembled puzzle elements on said base in the event that all of said puzzle elements have not been assembled in the assembled positions thereof before the expiration of said set period of time.

11. In the action toy game device of claim 10, said disassembling means comprising means for preventing the advancement of said timer unless said loading member is in the loaded position thereof.

* * * * *